US007097331B2

(12) United States Patent
Chen

(10) Patent No.: US 7,097,331 B2
(45) Date of Patent: Aug. 29, 2006

(54) SAFETY SWITCH CONTROL STRUCTURE

(75) Inventor: Yen-Chang Chen, Taipei Hsien (TW)

(73) Assignee: Variable Luminaire Ltd., Taipei Hsien (TW)

( * ) Notice: Subject to any disclaimer, the term of this patent is extended or adjusted under 35 U.S.C. 154(b) by 41 days.

(21) Appl. No.: 10/948,203

(22) Filed: Sep. 24, 2004

(65) Prior Publication Data

US 2006/0067080 A1 Mar. 30, 2006

(51) Int. Cl.
*F21V 23/04* (2006.01)

(52) U.S. Cl. ..... 362/394; 362/295; 362/656

(58) Field of Classification Search ..... 362/427, 362/428, 430, 652, 364, 365, 370, 371, 353, 362/259, 394, 656, 659; 200/51.09
See application file for complete search history.

(56) References Cited

U.S. PATENT DOCUMENTS 4,156,265 A * 5/1979 Rose ..... 361/179
4,450,512 A * 5/1984 Kristofek ..... 362/276
4,489,367 A * 12/1984 Herron et al. ..... 362/311
5,758,959 A * 6/1998 Sieczkowski ..... 362/365
6,203,169 B1 * 3/2001 Coushaine et al. ..... 362/652

* cited by examiner

*Primary Examiner*—John Anthony Ward
*Assistant Examiner*—Gunyoung T. Lee
(74) *Attorney, Agent, or Firm*—Troxell Law Office, PLLC

(57) ABSTRACT

A safety switch control structure for a lamp device, including outer mask shell for lamp device, lamp mask, fixing rack and interlock, wherein the fixing rack installed underneath the lamp device outer mask shell is equipped with interlock, the interlock is underneath the socket, above the interlock is installed with a spring piece, and a switch is underneath the spring piece, and the spring piece lock of interlock is underneath one of the spring clips; furthermore, the spring piece protruding part is underneath the clip part of the spring clip end. When the lamp mask is combined with the socket, the open spring clip on the socket lets the interlock contact socket and forms a conducting channel. When the lamp mask is separated from the socket, the spring clip goes back to its original shape and no longer contacts the spring piece of the interlock; no electricity is passing.

1 Claim, 6 Drawing Sheets

SAFETY SWITCH CONTROL STRUCTURE

BACKGROUND OF THE INVENTION

1. Field of the Invention

This invention relates to a safety switch control structure for a lamp device, it more specifically relates to a protection mechanism to be used during lamp dismantling and installing process through the installation of interlock.

2. Description of the Related Art

In normal lamp devices such as down-light and projection light, circuit can be conducted when light bulb is connected to the lamp base, normally, to save time, general users do not turn off the power during the light bulb changing process, this is not a correct process. A correct light bulb changing process is, turn off the power first to prevent any possible danger, this is the most important step and most people neglect it.

SUMMARY OF THE INVENTION

Since most people do not turn off the power before they change the light bulb, the inventor therefore provides a safety structure for a lamp device for improving the safety during light bulb changing process.

The main purpose of the current invention is to provide a lamp device structure which contains an interlock, the interlock is located underneath the socket of the outer mask shell of the lamp device, when the lamp mask is inserted and combined with socket, it can be contacted through the spring clip and spring piece in the socket, and electrical connection between the interlock and the socket can thus be opened, once the lamp is separated from the socket, the spring clip then goes back to its original shape immediately and no longer forms a contact with the spring piece of the interlock; therefore, no electricity passing through, and the lamp dismantling and installing process is thus safe.

BRIEF DESCRIPTIONS OF THE DRAWINGS

DETAILED DESCRIPTION OF THE PREFERRED EMBODIMENT

The preferred embodiments of the current invention are described in terms of features and structures accompanied with the drawings.

Figure 1:
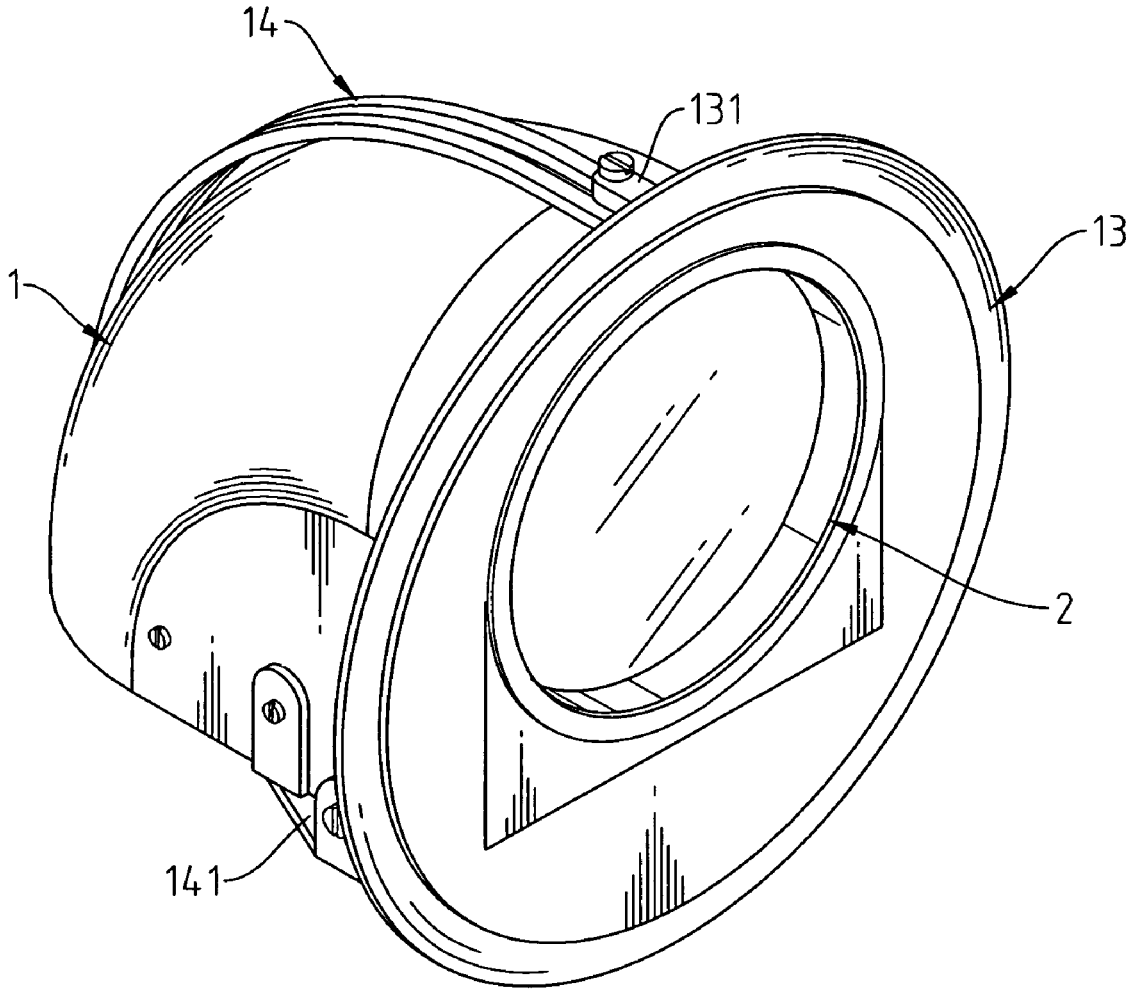
FIG. 1 shows the appearance stereo diagram of an assembly structure of the current invention.
Figure 2:
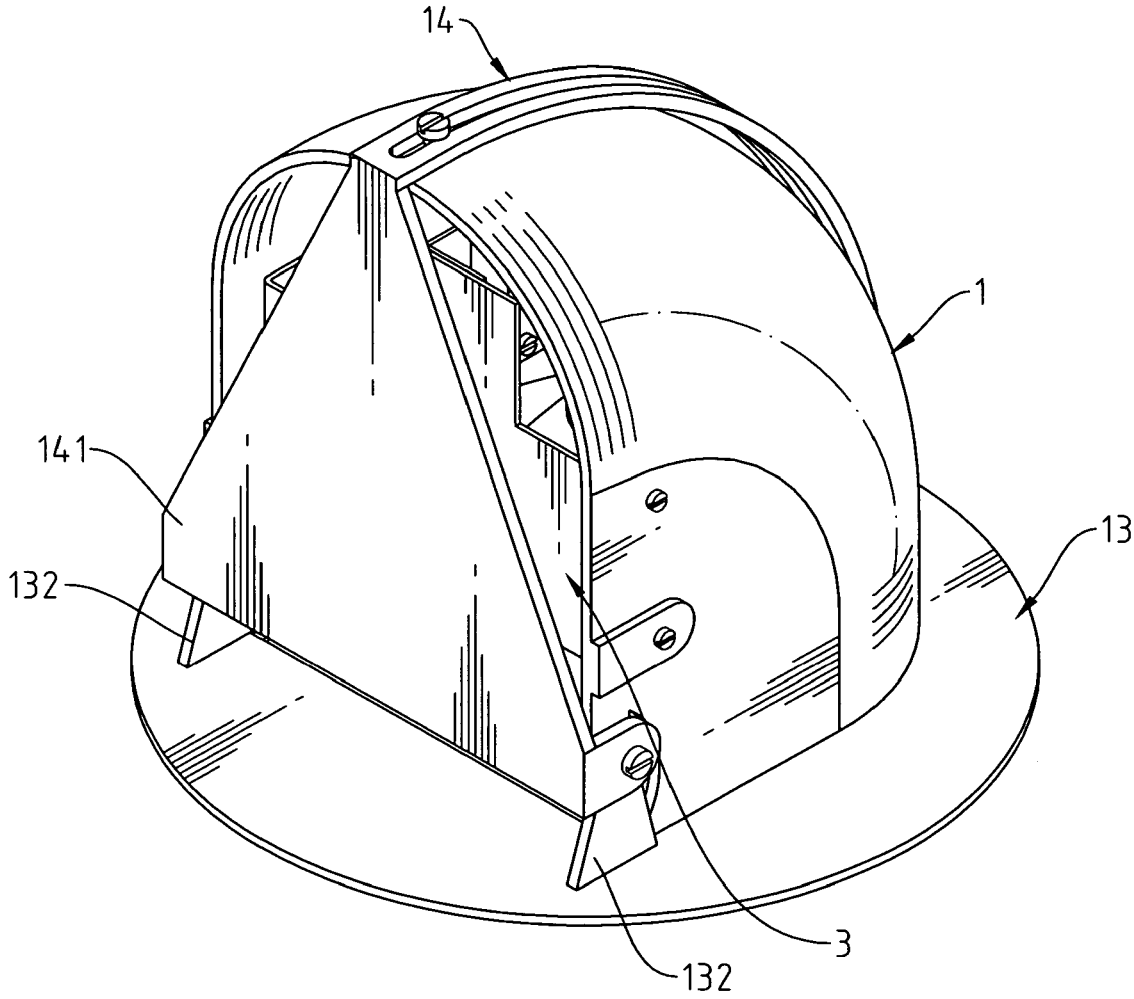
FIG. 2 shows the appearance stereo diagram of an assembly structure of the current invention viewed in another angle.
Figure 3:
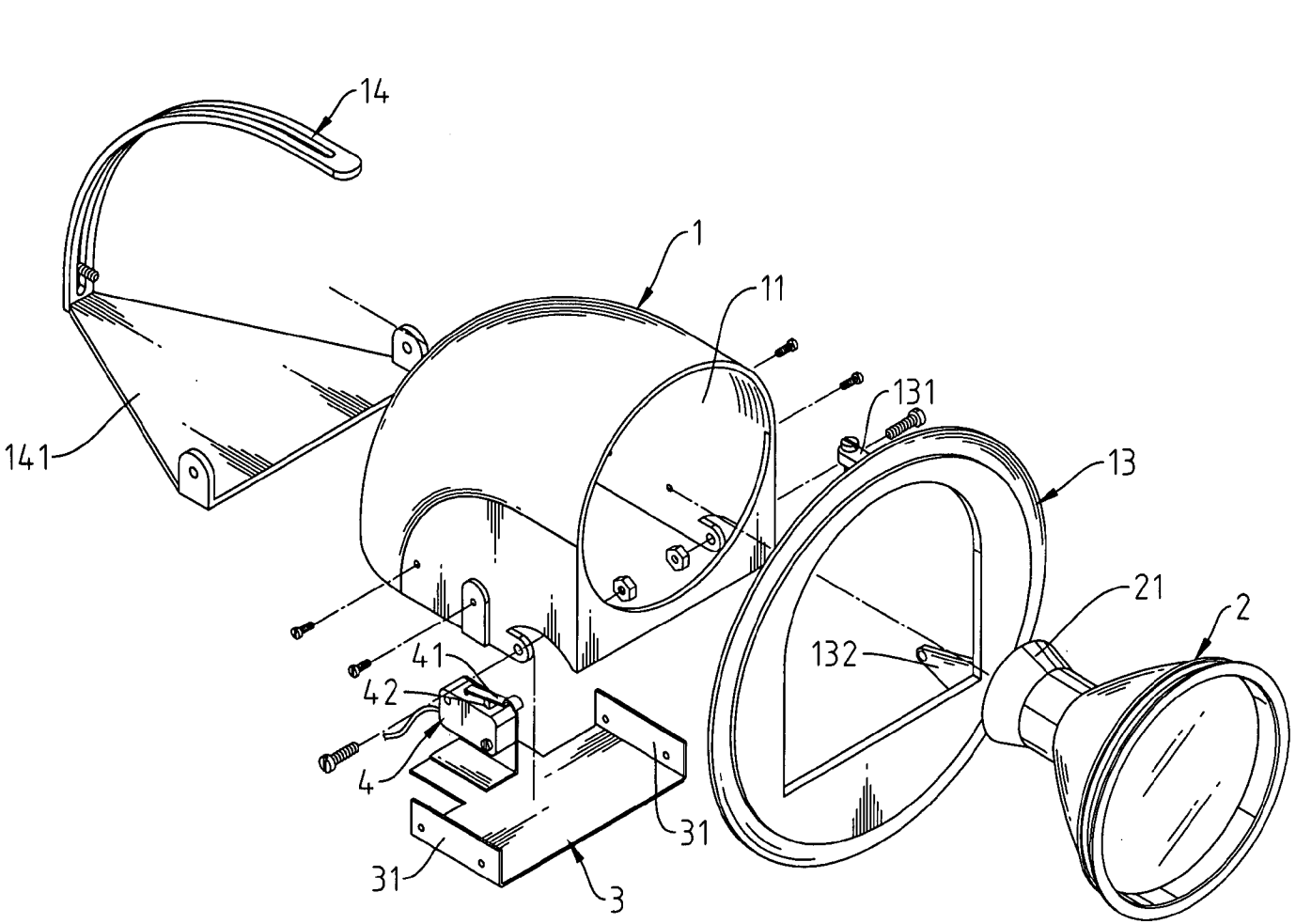
FIG. 3 is the structure decomposition stereo diagram of the current invention.

Please refer to FIG. 1 to FIG. 3, the safety switch control structure for the lamp device in the current invention mainly comprising of lamp device outer mask shell 1, lamp mask 2, fixing rack 3 and interlock 4, wherein the lamp device outer mask shell 1 is installed with opening 11, and its inner part is installed with socket 12, furthermore, spring clip 121 is installed at the peripheral of the socket 12, and the opening 11 can be connected to outer frame plate 13, the outer frame plate 13 can be decorated with opening 11 of lamp device outer mask shell 1, furthermore, lamp mask 2 can be installed in the socket 12 of the lamp device outer mask shell 1 through outer frame plate 13 and opening 11.

The above mentioned lamp device outer mask shell 1 has fixing rack 3, the connecting part 31 on both sides of the fixing rack 3 is locked and connected to lamp device outer mask shell 1; when the lamp device outer mask shell 1 is combined with outer frame plate 13 and the fixing rack 3 located underneath the lamp device outer mask shell 1, it can thus be locked and connected through the upper end of fixing and connecting piece 14 and the locking end 131 of the outer frame plate 13, furthermore, the lower end of the fixing and connecting piece 14 is formed integrally and installed with bottom support rack 141, both ends of it can be connected and locked to the lower end locking piece 132 of outer frame plate 13; moreover, the fixing rack 3 installed underneath the lamp device outer mask shell 1 is installed with interlock 4, it is installed right underneath the socket 12, a spring piece 41 is installed above the interlock 4, a switch 42 is installed underneath the spring piece 41, and the locking location of spring piece 41 of interlock 4 is just underneath one of the spring clip 121 of many spring clips 121, furthermore, the protruding end of spring piece 41 is just located underneath the clip part 122 of the end of spring clip 121, moreover, electrical wire 43 is used to connect the socket 12 and interlock 4.

Figure 4:
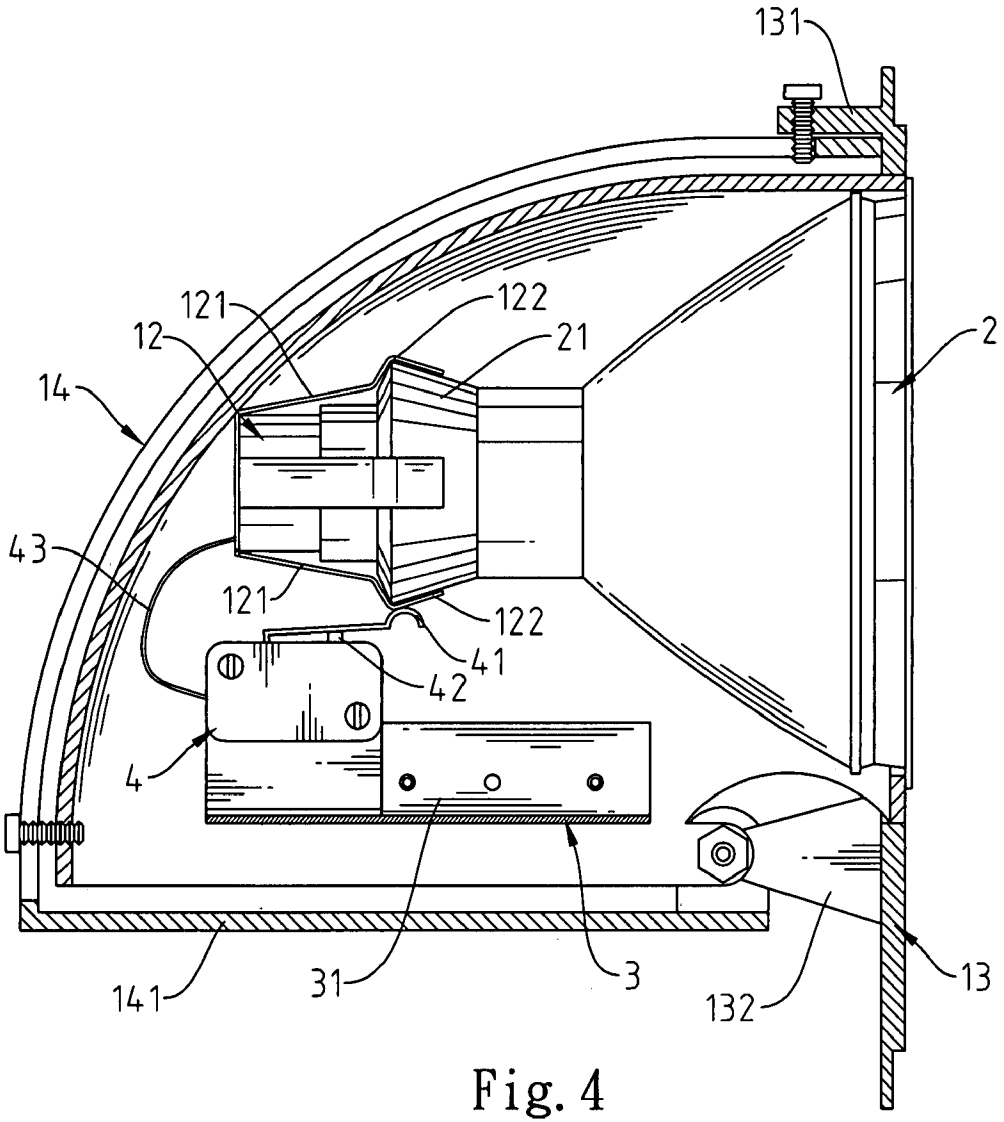
FIG. 4 shows the inner assembly structure stereo diagram of the current invention.
Figure 5:
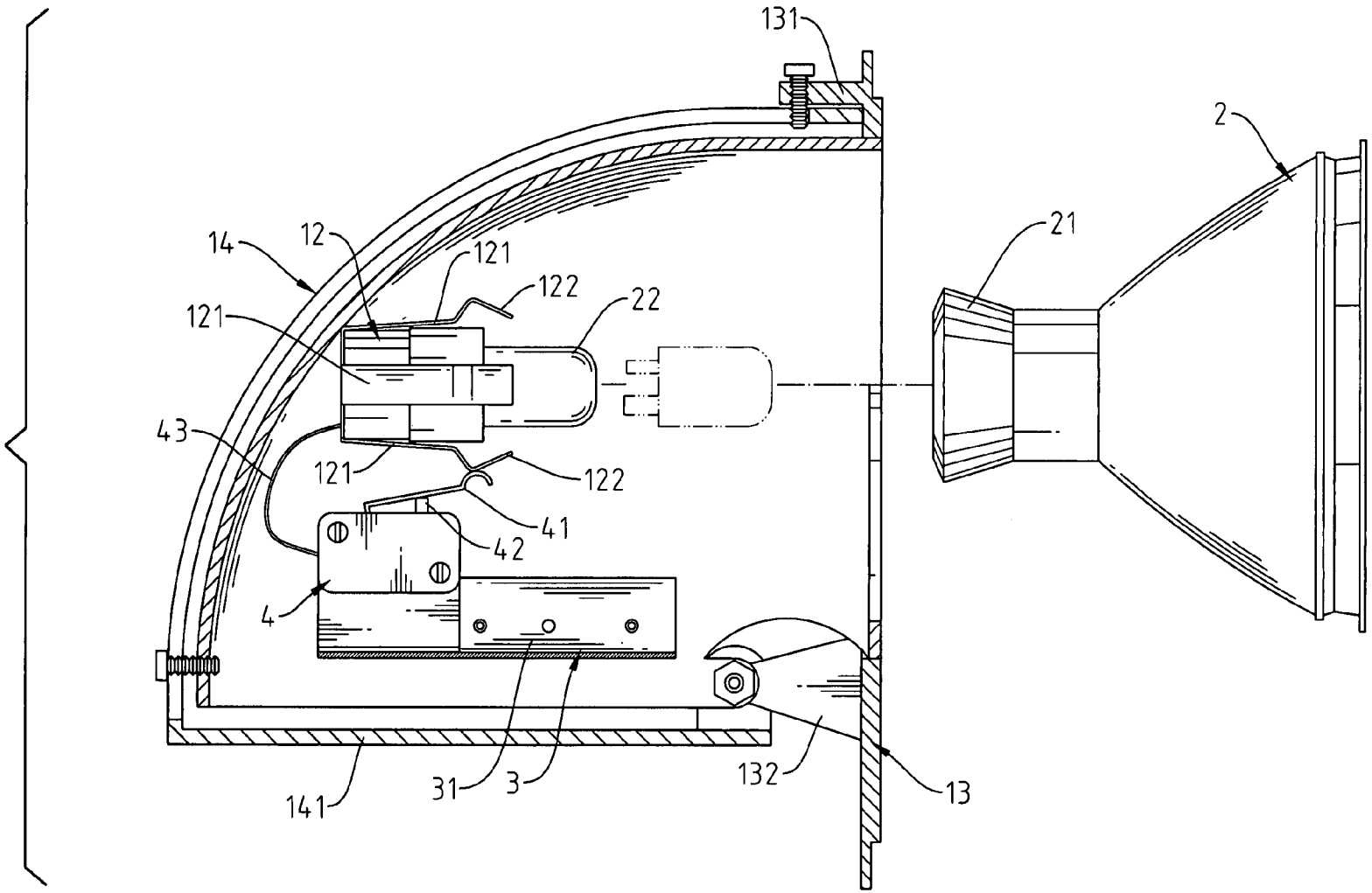
FIG. 5 shows the embodiment when light bulb is changed.

For the usage condition when lamp mask 2 is desired to be combined with the inside of lamp device outer mask shell 1, please refer to FIG. 4 and FIG. 5, when lamp mask 2 is inserted into lamp device outer mask shell 1 through outer frame plate 13 and opening 11, the light bulb 22 installed at the inserting and connecting head 21 of lamp mask 2 is plugged and connected with the socket 12, at the same time, the external part of inserting and connecting head 21 can spread wide the spring clip 121, meanwhile, spring clip 121 can clip the inserting and connecting head 21; when spring clip 121 is spread wide along with the outer shape of inserting and connecting head 21, the clip part 122 of the spring clip 121 will then contact the spring piece 41 of the interlock 4, furthermore, spring piece 41 will compress the switch 42 underneath it, at this time, the electrical wire 43 between socket 12 and interlock 4 can thus conduct and the light bulb 22 on the socket 12 will thus light up, therefore, the lamp device is conducting.

In addition, during the dismantling of the lamp mask 2, once the lamp mask 2 is taken away from contact with socket 12, the spring clip 121 installed on the socket 12 will then go back to its original shape, it thus is not conducting with the sprig piece 41 on the interlock 4, therefore, the spring clip 121 and spring piece 41 are thus not in contact and electricity is not conducting, an interlock protection function is thus formed between both, and the user can dismantle light bulb 22 under safety condition without electricity flowing, this safety structure can thus bring user safety.

Figure 6:
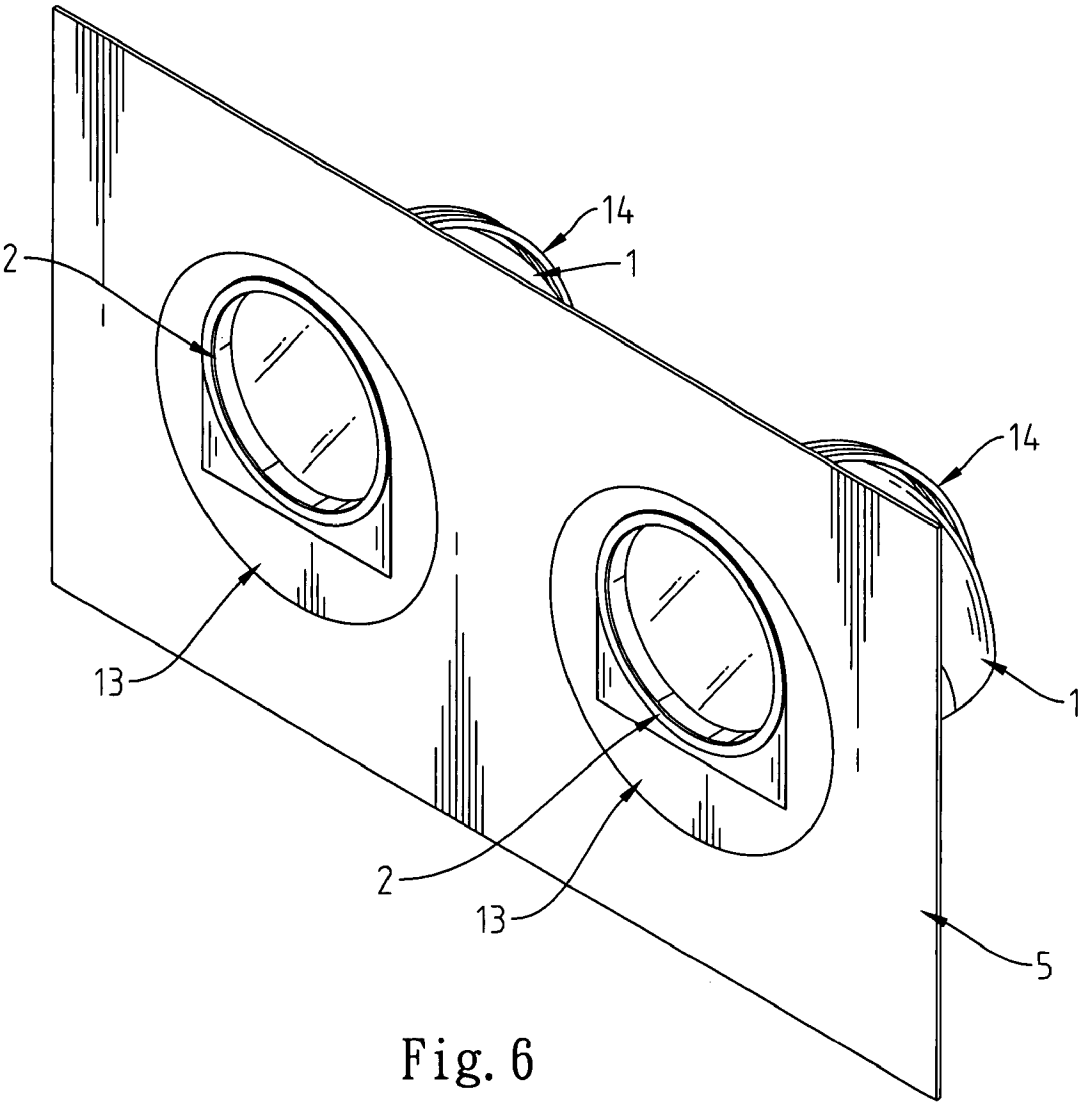
FIG. 6 shows an embodiment in usage for the current invention.

Please further refer to FIG. 6, the lamp device in this invention can be single one or multiple ones which are decorated and fixed by decoration plate rack 5 simultaneously, and the lamp device thus looks more beautiful.

What the invention claimed is:

1. A safety switch control structure for a lamp device comprising:

a lamp device outer mask shell, a lamp mask, a fixing rack and an interlock, wherein the lamp device outer mask shell has an opening and a socket located on an inner side thereof, the opening is connected to an outer frame plate, the lamp mask is installed inside the lamp device outer mask shell and is combined with the socket through the outer frame plate and the opening;

a bottom of the lamp device outer mask shell is connected to and installed with the fixing rack, the fixing rack installed underneath the lamp device outer mask shell is installed with the interlock, and the interlock is installed underneath the socket, a spring piece is installed above the interlock and a switch is installed underneath the spring piece, and the spring piece of the interlock is installed underneath one of a plurality of spring clips, and a spring protruding part is located underneath a lower part of a clip art of one of the plurality of spring clips;

the lamp mask is connected to the socket through an inserting and connecting head of the lamp mask, when the spring clip is spread wide along with a change of an outer shape of the inserting and connecting head, the clip part of the spring clip will then contact the spring piece of the interlock, and the spring piece will compress the switch, the electrical wire installed between the socket and the interlock will then become conducting, when the lamp mask is taken away from contact with socket, the spring clip installed on the socket will then go back to its original shape, the electrical wire will not be conducting with the spring piece on the interlock.

* * * * *